US006161819A

United States Patent [19]

Edwards

[11] Patent Number: 6,161,819

[45] Date of Patent: Dec. 19, 2000

[54] CARBONATOR CARTRIDGE UNIT FOR A BEVERAGE DISPENSER SYSTEM

[75] Inventor: William A. Edwards, Lavernia, Tex.

[73] Assignee: Lancer Partnership, Ltd., San Antonio, Tex.

[21] Appl. No.: 09/267,171

[22] Filed: Mar. 12, 1999

[51] Int. Cl.[7] ..... B01F 3/04

[52] U.S. Cl. ..... 261/74; 261/119.1; 261/DIG. 7; 426/477

[58] Field of Search ..... 261/74, 119.1, 261/127, DIG. 7; 426/474, 477

[56] References Cited

U.S. PATENT DOCUMENTS

| | | | |
|---|---|---|---|
| 841,247 | 1/1907 | Higginson | 261/DIG. 7 |
| 3,578,214 | 5/1971 | Iannelli | 261/DIG. 7 |
| 4,359,432 | 11/1982 | Sedam et al. | 261/DIG. 7 |
| 4,555,371 | 11/1985 | Jeans | 261/DIG. 7 |
| 5,112,539 | 5/1992 | Parnet | 261/119.1 |
| 5,419,461 | 5/1995 | Goulet | 261/DIG. 7 |

*Primary Examiner*—C. Scott Bushey
*Attorney, Agent, or Firm*—Christopher L. Makay; Rafael V. Baca

[57] ABSTRACT

A beverage dispenser system for forming a desired beverage, includes a beverage dispensing assembly and a carbonator cartridge unit removably secured to the beverage dispensing assembly for providing a supply of carbonated water to the beverage dispensing assembly. The beverage dispenser system includes a connector for removably securing the carbonator cartridge unit to the beverage dispensing assembly. A carbonated water line, linked with the carbonator cartridge unit and linked with the beverage dispensing assembly, is provided for delivering carbonated water from the carbonator cartridge unit to the beverage dispensing assembly. The beverage dispensing assembly provides beverage fluid lines so that beverage fluids flowing therein are combined within the beverage dispensing assembly and are ultimately dispensed from the beverage dispensing assembly as the desired beverage.

10 Claims, 3 Drawing Sheets

CARBONATOR CARTRIDGE UNIT FOR A BEVERAGE DISPENSER SYSTEM

BACKGROUND OF THE INVENTION

1. Field of the Invention

The present invention generally relates to dispensing equipment and, more particularly, but not by way of limitation, to an interchangeable carbonator for facilitating easy attachment and removal from a beverage dispenser system and for providing a supply of carbonated water to a beverage dispenser system 2. Description of the Related Art Typically, beverage dispenser systems dispense a beverage flavored syrup mixed with either carbonated water to form a carbonated drink, such as cola, or plain water to form a noncarbonated drink, such as punch. Beverage dispenser systems often include carbonators for providing a supply of carbonated water therefrom. Beverage dispenser systems further include cooling units, such as a cold plate, for cooling plain and carbonated water as well as beverage flavored syrup prior to forming a desired beverage in that it is highly desirable in the industry to serve carbonated drinks at the coldest temperature possible.

Beverage dispenser systems typically feature separate lines for passing plain water, carbonated water, and beverage flavored syrup to a beverage dispenser system's dispensing valves whereby a desired drink is formed. A plain water line delivers water from a plain water source, such as a public water line, across a cooling unit to either a carbonator to form carbonated water for a carbonated drink or directly to the dispensing valves to form a noncarbonated drink. Additionally, carbon dioxide is delivered from a carbon dioxide source across a carbon dioxide line to the carbonator to form carbonated water. A carbonated water line delivers carbonated water from the carbonator to the dispensing valves where carbonated water is combined with beverage flavored syrup to thus form a carbonated drink. Accordingly, a beverage flavored syrup line delivers beverage flavored syrup from a beverage flavored syrup source, across the cooling unit to the dispensing valves.

Current carbonators include a tank with an interior portion wherein carbonated water is formed and collected. A carbon dioxide inlet, having one end in communication with a carbon dioxide source and another end in communication with the interior portion of the tank, delivers pressurized carbon dioxide from the carbon dioxide line to the interior portion of the tank. A water inlet, having one end in communication with the water line and another end in communication with the interior portion of the tank, delivers water from the plain water source to the interior portion of the tank. Upon their entry, plain water and carbon dioxide combine under pressure within the interior portion to form carbonated water. The newly formed carbonated water collects in the tank and exits from an outlet across the carbonated water line to, ultimately, form a carbonated drink.

Current carbonator design, however, does not provide for easy attachment or removal from a beverage dispenser system, especially during maintenance and repair. Carbonators are typically positioned substantially adjacent to a cooling unit within a beverage dispenser system such that considerable disassembly of a beverage dispenser system is often required to gain access to a carbonator. Beverage dispenser systems featuring cold plates, for example, position carbonators within a cold plate or in front of the beverage dispenser system amid a dense maze of beverage fluid lines, thereby unfavorably increasing the time that a beverage dispenser must be removed from operation while gaining access to a carbonator.

Accordingly, there is a long felt need for a carbonator that provides for easy accessibility as well as easy attachment to and removal from a beverage dispenser system to substantially reduce the time that a beverage dispenser must be removed from operation while gaining access to a carbonator.

SUMMARY OF THE INVENTION

In accordance with the present invention, a beverage dispenser system for forming a desired beverage, includes a beverage dispensing assembly and a carbonator cartridge unit removably secured to the beverage dispensing assembly for providing a supply of carbonated water to the beverage dispensing assembly. The beverage dispenser system includes a connector for removably securing the carbonator cartridge unit to the beverage dispensing assembly. A carbonated water line, linked with the carbonator cartridge unit and linked with the beverage dispensing assembly, is provided for delivering carbonated water from the carbonator cartridge unit to the beverage dispensing assembly. The beverage dispensing assembly provides beverage fluid lines so that beverage fluids flowing therein are combined within the beverage dispensing assembly and are ultimately dispensed from the beverage dispensing assembly as the desired beverage. Furthermore, the beverage dispensing system includes an assembly housing and dispensing valves linked with the dispensing housing for dispensing the desired beverage therefrom.

The carbonator cartridge unit, in particular, includes a unit housing and a tank disposed within the unit housing. The tank defines an exterior portion and an interior portion wherein carbonated water is formed. The carbonator cartridge unit includes linking passageways disposed along the exterior portion of the tank and passing through the unit housing. The linking passageways carry fluids for forming carbonated water from the beverage fluid lines to the interior portion of the tank and deliver carbonated water from the tank to the beverage dispensing assembly.

Accordingly, the connector allows the beverage fluid lines and the carbonated water line of the beverage dispensing assembly to communicate with the linking passageways of the carbonator cartridge unit. The connector includes a fitting assembly that provides a seal.

The fitting assembly includes a coupling that defines a bore therethrough. The bore provides a passageway through the assembly housing of the beverage dispensing assembly and the unit housing of the carbonator cartridge. In particular, the bore receives a line from the beverage fluid lines and a respective linking passageway from the linking passageways, thereby allowing the line to communicate with the respective linking passageway.

In one embodiment, the carbonator cartridge unit includes a bypass tube, disposed within the unit housing, in communication with the beverage fluid lines and the carbonated water line. As such, the bypass tube is operationally engaged while a supply of carbonated water is not required.

In accordance with the present invention, a method for providing a supply of carbonated water to a beverage dispensing system, includes operatively linking a beverage dispensing assembly with a carbonator cartridge unit. Water and carbon dioxide are introduced to the beverage dispensing assembly across beverage fluid lines from the beverage dispensing assembly and are delivered to the carbonator cartridge unit via linking passageways. Water and carbon dioxide are combined within a tank from the carbonator cartridge unit to form carbonated water. Carbonated water is introduced to the beverage dispensing system, via a carbonated water line. Ultimately, carbonated water in the form of a desired drink is dispensed from the beverage dispensing system's dispensing valves that are linked with the carbonated water line.

It is therefore an object of the present invention to provide a carbonator and associated method that provides for easy accessibility as well as easy attachment to and removal from a beverage dispenser system.

It is a further object of the present invention to provide an interchangeable carbonator for facilitating easy attachment and removal from a beverage dispenser system and for providing a supply of carbonated water to a beverage dispenser system.

Still other objects, features, and advantages of the present invention will become evident to those skilled in the art in light of the following.

DETAILED DESCRIPTION OF THE PREFERRED EMBODIMENT

Figure 1:
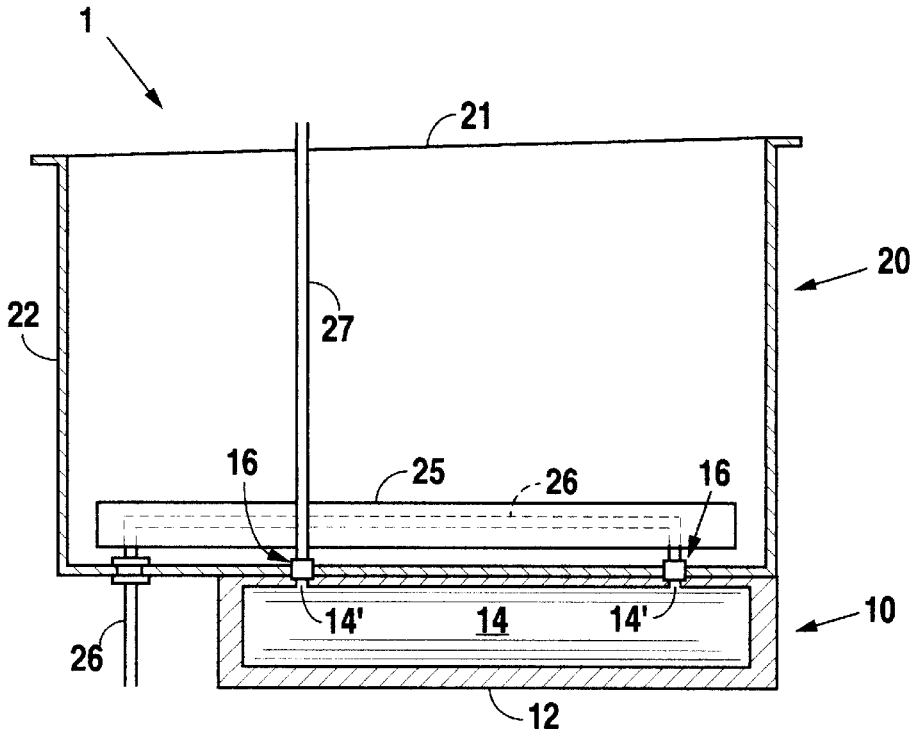
FIG. 1 is a cross-sectional frontal view illustrating a beverage dispenser system according to the preferred embodiment featuring a carbonator cartridge unit whereby the carbonator cartridge unit is removably secured to the beverage dispenser system and provides a supply of carbonated water therefrom.

As required, detailed embodiments of the present invention are disclosed herein; however, it is to be understood that the disclosed embodiments are merely exemplary of the invention, which may be embodied in various forms. The figures are not necessarily to scale, and some features may be exaggerated to show details of particular components or steps.

As illustrated in FIGS. 1–4 a beverage dispenser system 1 includes a carbonator cartridge unit 10 and a beverage dispensing assembly 20, whereby the carbonator cartridge unit 10 is removably secured to the beverage dispensing assembly 20 and provides a supply of carbonated water therefrom. It should be emphasized that the word "removably", as used in this description and in the appended claims, refers to easy attachment to and removal from a beverage dispenser system.

The beverage dispensing assembly 20 includes an assembly housing 21 defining a housing wall 22. The preferred beverage dispensing assembly 20 includes a cooling unit 25 disposed within assembly housing 21 for cooling plain and carbonated water as well as beverage flavored syrup prior to forming a desired beverage in that it is highly desirable in the industry to serve carbonated drinks at the coldest temperature possible. As shown in FIGS. 1–4, cooling unit 25 is preferably a standard cold plate used in the industry although those skilled in the art will recognize other suitable and equivalent means for cooling beverage fluids.

The beverage dispensing assembly 20 includes lines 26 for passing beverage fluids, such as plain water, carbonated water, and beverage flavored syrup, to a beverage dispenser system's dispensing valves (not shown) wherein a desired drink is formed. As such, lines 26 deliver water from a plain water source (not shown), such as a public water line, across the cooling unit 25 within the beverage dispensing assembly to either the carbonator cartridge unit 10 to form carbonated water for a carbonated drink, such as cola, or directly to the dispensing valves to form a noncarbonated drink, such as punch. In addition, lines 26 deliver beverage flavored syrup from a beverage flavored syrup source, across the cooling unit 25 to the dispensing valves of the beverage dispenser system 1.

Figure 2:
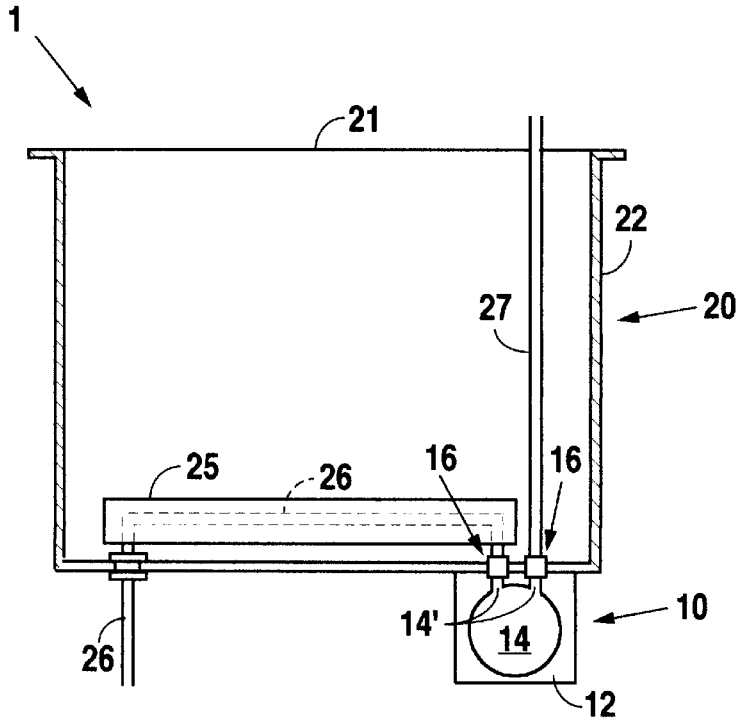
FIG. 2 is a cross-sectional side view illustrating the beverage dispenser system according to the preferred embodiment.

Moreover, carbon dioxide is delivered from a carbon dioxide source (not shown) across the beverage dispensing assembly 20, via lines 26, to the carbonator cartridge unit 10 to form carbonated water. Although those skilled in the art may contemplate other configurations for lines 26, FIGS. 1–2 depict the preferred configuration for lines 26. Inasmuch, the preferred embodiment allows lines 26 to pass through the cooling unit 25 to cool carbon dioxide prior to entering tank 14, thereby enhancing the carbonated water formation process.

Accordingly, in operation, carbon dioxide and water are delivered by lines 26 through the beverage dispensing assembly 20 to the carbonator cartridge unit 10, whereby carbon dioxide and water combine under pressure in tank 14 to form carbonated water. Furthermore, the preferred beverage dispensing assembly 20 includes a carbonated water line 27 that delivers carbonated water from the carbonator cartridge unit 10 to the dispensing valves where carbonated water is combined with beverage flavored syrup to form a desired carbonated drink. Other embodiments contemplate the carbonated water line 27 passing from the carbonator cartridge unit 10, across the cooling unit 25 to the dispensing valves to enhance the drink formation process by further cooling carbonated water prior to entering the dispensing valves.

Referring to FIGS. 1–2, the carbonator cartridge unit 10 includes a unit housing 12. Unit housing 12 enables the carbonator cartridge unit 10 to be conveniently removed from the beverage dispenser system 1 as a single piece. Unit housing 12 may be configured in any shape necessary to meet the space requirements for a carbonator cartridge unit 10 that is integrated with a beverage dispenser system 1. In the preferred embodiment, carbonator cartridge unit 10 is coupled with the beverage dispensing assembly 20 using any suitable means so that unit housing 12 contacts housing wall 22. This contact thus provides for easy accessibility to the carbonator cartridge unit 10 by minimizing obstructions potentially created by the beverage dispensing unit 20 between the unit housing 12 and housing wall 22 as, for example, beverage fluid lines were in the past.

The carbonator cartridge unit 10, in the preferred embodiment, includes a tank 14 defining an interior portion wherein carbonated water is formed and collected. Tank 14 may be configured in any shape necessary to meet the space requirements for a carbonator cartridge unit 10 and, in this preferred embodiment, is constructed from any suitable material such as metal or hard plastic.

According to the preferred embodiment, the carbonator cartridge unit 10 includes linking passageways 14' disposed along an exterior portion of tank 14 and passing through unit housing 12. The linking passageways 14' are for delivering fluids to the tank 14 for forming carbonated water or for delivering carbonated water to the beverage dispensing assembly 20. In particular, a first set of linking passageways from linking passageways 14' delivers carbon dioxide and water to tank 14 to form carbonated water therein and a second set of linking passageways delivers carbonated water from tank 14 to the beverage dispensing assembly 20.

One embodiment of the carbonator cartridge unit 10 contemplates interchangeable linking passageways. Thus, in effect, each linking passageway of the interchangeable linking passageways functions as either an inlet to or an outlet from tank 14 depending on the carbonator cartridge unit's 10 placement relative to the beverage dispensing assembly 20.

Illustratively, for a carbonator cartridge unit 10 in a first position, a first linking passageway and a second linking passageway from a first set of interchangeable linking passageways (not shown) are coupled to lines 26 to receive carbon dioxide and water, thereby functioning as inlets to tank 14. In the first position, a third linking passageway from a second set of interchangeable linking passageways (not shown) is coupled to carbonated water line 27 to deliver carbonated water to the beverage dispenser system 1, thereby functioning as an outlet from tank 14. After detachment from the beverage dispensing assembly 20, the carbonator cartridge unit is secured to the beverage dispenser system 1 in a second position. In the second position, the first and second linking passageways now function as outlets for tank 14 and the third and a fourth passageway function as inlets for tank 14. It should be added that there is a sufficient number of linking passageways to accommodate a carbonator cartridge unit's 10 placement in either a first or a second position and that any unused passageways are sufficiently sealed off.

Figure 5:
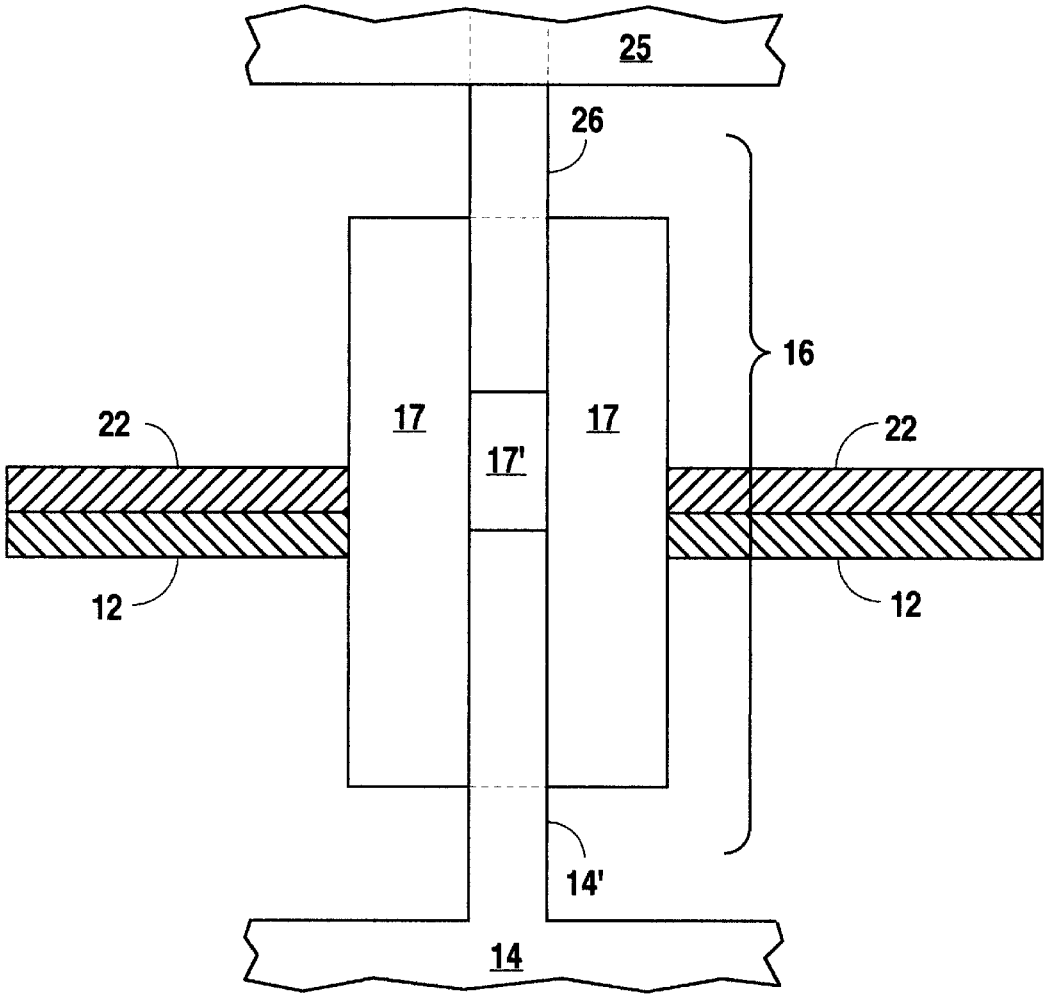
FIG. 5 is a cross-sectional view illustrating a preferred fitting assembly for removably securing a carbonator cartridge unit to a beverage dispenser system.

Beverage dispenser system 1 includes a connector that allows lines 26 and carbonated water line 27 of beverage dispensing assembly 20 to communicate with linking passageways 14' of carbonator cartridge unit 10 for the formation and distribution of carbonated water for the beverage dispenser system 1. As such, the carbonator cartridge unit 10 is removably secured to the beverage dispensing assembly 20 via the connector. In the preferred embodiment, the connector includes a fitting assembly 16. As shown in FIG. 5, fitting assembly 16 includes a coupling 17 for allowing a line from lines 26 to communicate with a linking passageway from linking passageways 14' to allow either water or carbon dioxide to thus enter tank 14. Although coupling 17 in FIG. 5 communicates with lines 26, coupling 17 can be configured to communicate with carbonated water line 27 in the same manner.

In FIG. 5, coupling 17 defines a bore 17' therethrough for receiving the line from lines 26 and for receiving the linking passageway from linking passageways 14'. Moreover, the outer walls defining bore 17' secure the line from lines 26 and the linking passageway from linking passageways 14' within coupling 17. Coupling 17, in turn, is secured to and passes through beverage dispensing assembly 20 and carbonator cartridge unit 10, thereby allowing bore 17' to provide a passageway through the housing wall 22 of beverage dispensing assembly 20 and the unit housing 12 of carbonator cartridge unit 10. Coupling 17 also provides a seal to ensure that the path from a line of lines 26 across bore 17 to a linking passageway from linking passageways 14' is maintained without any significant seeping or leakage.

In operation, according to the preferred embodiment in FIGS. 1–2, carbon dioxide and water are brought from their respective sources to the beverage dispenser system 1 through lines 26. Lines 26 enter the beverage dispensing assembly 20, through assembly housing 21, and pass through the cooling unit 25, and are received by fitting assembly 16. Carbon dioxide and water pass from fitting assembly 16 and enter a first set of linking passageways 14' from carbonator cartridge unit 10. Carbon dioxide and water enter tank 14 via the first set of linking passageways 14' and combine under pressure to form carbonated water. Carbonated water exits tank 14 via a second set of linking passageways 14' and enters carbonated water line 27. Carbonated water line 27 thus delivers carbonated water to the dispensing valves where it is combined with beverage flavored syrup to form a desired carbonated drink.

Figure 3:
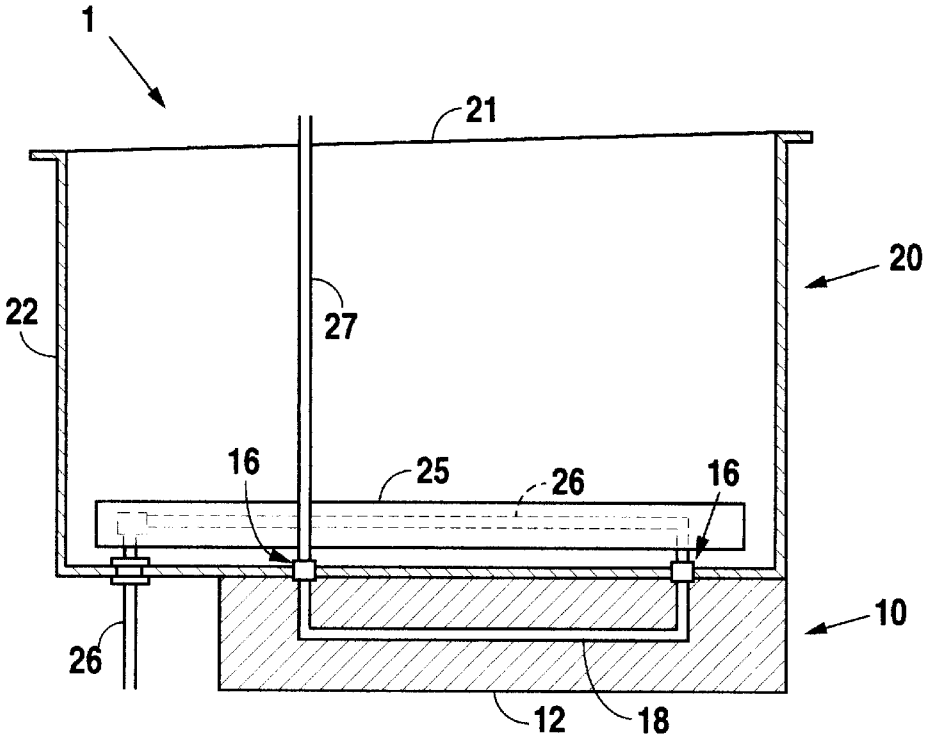
FIG. 3 is a cross-sectional frontal view illustrating one embodiment of the beverage dispenser system featuring a removable carbonator cartridge unit with a bypass tube for use when a supply of carbonated water is not required.
Figure 4:
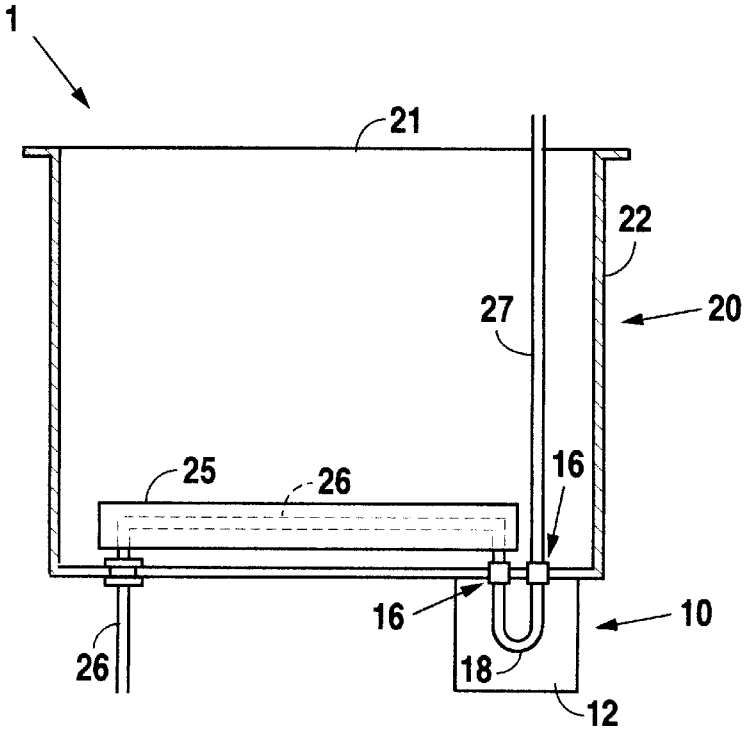
FIG. 4 is a cross-sectional side view illustrating the embodiment of the beverage dispenser system featuring a removable carbonator cartridge unit with a bypass tube.

Furthermore, FIGS. 3–4 show one embodiment of the beverage dispenser system 1 featuring a carbonator cartridge unit 10 with a bypass tube 18 for use when a supply of carbonated water is not required. In particular, water flows through lines 26 across cooling unit 25 to a first fitting assembly 16. From the first fitting assembly 16, water enters the carbonator cartridge unit 10 through bypass tube 18. Water travels across bypass tube 18 to a second fitting assembly 16 and, therefrom, is redirected into the beverage dispensing assembly 20. As such water enters carbonated water line 27 to thus deliver plain water to the dispensing valves where it is combined with beverage flavored syrup to form a desired noncarbonated drink. Although FIGS. 3–4 show a carbonator cartridge unit 10 with a bypass tube 18, other embodiments of the beverage dispenser system 1 contemplate a carbonator cartridge unit 10 with a bypass tube as well as a tank 14 for forming carbonated water. Thus, depending on the carbonator cartridge unit's 10 placement relative to the beverage dispensing assembly 20, either the bypass tube 18 or the tank 14 may be selectively engaged.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims that follow.

I claim:

1. A beverage dispenser system for forming a desired beverage, comprising:

a beverage dispensing assembly including beverage fluid lines for passing beverage fluids through the beverage dispensing assembly so that beverage fluids flowing therein are combined within the beverage dispensing assembly and are ultimately dispensed from the beverage dispensing assembly as the desired beverage;

a carbonator cartridge unit removably secured to the beverage dispensing assembly for providing a supply of carbonated water therefrom;

a first connector coupled to a beverage fluid line for removably securing the carbonator cartridge unit to the beverage dispensing assembly, wherein the beverage fluid line delivers plain water to the carbonator cartridge unit;

a second connector coupled to a beverage fluid line for removably securing the carbonator cartridge unit to the beverage dispensing assembly, wherein the beverage fluid line delivers carbon dioxide to the carbonator cartridge unit; and a beverage fluid line coupled with the carbonator cartridge unit for delivering carbonated water from the carbonator cartridge unit through the beverage dispensing assembly.

2. The beverage dispenser system according to claim 1 wherein the carbonator cartridge unit comprises:

a unit housing, a unitary, single piece construction carbonator tank disposed within the unit housing, and linking passageways disposed along the exterior portion of the tank and passing through the unit housing.

3. The beverage dispenser system according to claim 2 wherein the linking passageways deliver fluids for forming carbonated water from the beverage fluid lines to the tank.

4. The beverage dispenser system according to claim 2 wherein the linking passageways deliver carbonated water from the tank to the beverage dispensing assembly.

5. The beverage dispenser system according to claim 1, further comprising:

a bypass tube removably secured to the beverage dispensing assembly in the place of the carbonator cartridge unit for providing a supply of plain water therefrom.

6. The beverage dispenser system according to claim 2 wherein the first connector allows the beverage fluid line of the beverage dispensing assembly to communicate with a linking passageway of the carbonator cartridge unit.

7. The beverage dispenser system according to claim 2 wherein the second connector allows the beverage fluid line of the beverage dispensing assembly to communicate with a linking passageway of the carbonator cartridge unit.

8. The beverage dispenser system according to claim 2 wherein the first and second connectors comprise a fitting assembly.

9. The beverage dispenser system according to claim 8 wherein the fitting assembly provides a seal.

10. The beverage dispenser system according to claim 8 wherein the fitting assembly comprises:

a coupling, the coupling defining a bore therethrough for receiving the first or second connector, thereby allowing the first or second connector to communicate with a respective linking passageway.

* * * * *